US006701580B1

(12) United States Patent
Bandyopadhyay

(10) Patent No.: US 6,701,580 B1
(45) Date of Patent: Mar. 9, 2004

(54) INTERLOCKING FASTENER INCLUDING ADHESIVE PORTIONS

(75) Inventor: Pradip K. Bandyopadhyay, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/314,181

(22) Filed: Dec. 5, 2002

(51) Int. Cl.[7] ..... A44B 21/00; A44B 18/00; B65D 63/00

(52) U.S. Cl. ..... 24/16 R; 24/306; 24/304

(58) Field of Search ..... 24/304, 306, 442, 24/452; 428/99, 100

(56) References Cited

U.S. PATENT DOCUMENTS

| | | | | | |
|---|---|---|---|---|---|
| 3,620,896 | A | * | 11/1971 | Glasgow | 428/167 |
| 4,149,540 | A | | 4/1979 | Hasslinger | |
| 4,815,172 | A | * | 3/1989 | Ward | 24/16 R |
| 5,142,743 | A | | 9/1992 | Hahn | |
| 5,168,603 | A | | 12/1992 | Reed | |
| 5,548,871 | A | | 8/1996 | Trethewey | |
| 5,604,961 | A | * | 2/1997 | Cole | 24/306 |
| 5,636,414 | A | * | 6/1997 | Litchholt | 24/304 |
| 5,802,676 | A | | 9/1998 | Tolan | |
| 5,870,849 | A | * | 2/1999 | Colson, Jr. | 43/25.2 |
| 6,044,525 | A | * | 4/2000 | Sastre et al. | 24/20 R |
| 6,393,673 | B1 | * | 5/2002 | Kourtidis et al. | 24/304 |
| 6,484,371 | B1 | * | 11/2002 | Romanko et al. | 24/306 |
| 6,588,074 | B2 | * | 7/2003 | Galkiewicz et al. | 24/586.1 |
| 2003/0110596 | A1 | * | 6/2003 | Graham et al. | 24/16 R |

FOREIGN PATENT DOCUMENTS

| | | |
|---|---|---|
| EP | 0 418 954 A2 | 3/1991 |
| EP | 0 894 448 A1 | 2/1999 |

* cited by examiner

*Primary Examiner*—Robert J. Sandy
(74) *Attorney, Agent, or Firm*—Melanie G. Gover

(57) ABSTRACT

An interlocking fastener, preferably in the form of an elongate strip, holds at least one object in a substantially immobile condition. The interlocking fastener comprises a backing sheet having a first side opposite a second side and a first end opposite a second end. A plurality of first connecting elements, attached to the first side of the backing sheet, releasably engage a plurality of second connecting elements attached to the second side of the backing sheet during formation of a wrapped fastening strip. The interlocking fastener has a deposit of a pliable material at a plurality of boundaries between areas of the connecting elements on at least the first side of the backing sheet to provide at least frictional contact immobilizing the object to substantially prevent it from moving following formation of the wrapped fastening strip by overlap of the first end and the second end.

12 Claims, 3 Drawing Sheets

INTERLOCKING FASTENER INCLUDING ADHESIVE PORTIONS

BACKGROUND OF THE INVENTION

1. Field of the Invention

The invention relates to articles for binding objects that need to be isolated singly or held as organized groups of objects. More particularly the present invention provides an interlocking fastener, preferably in strip form, that holds objects within a wrapped binding held together by interference of interlocking elements. The surface of the interlocking fastener, in contact with objects to be held, includes material for at least frictional contact with the objects.

2. Description of the Related Art

A variety of well-known materials, devices and methods exist for the purpose of tying objects to surfaces or tying them together into organized groups or bundles. String or twine have long been used this purpose. These materials may be used, for instance, to attach hoses, wires, cables and electrical supply cords and the like to walls or beams or other types of structure. In the process of attachment, a length of string may be wrapped around a single wire or cable before tying it to a suitable part of a selected structure. The same process may be used to prepare a group or bundle of wires or cables that may be wrapped inside a length of string to retain them in an organized group.

The use of string as a wrapping and binding material has the advantage of low cost. A disadvantage of this material is the difficulty of retaining tension in the wrapped string while forming a suitable knot to hold objects held singly or in an organized group. After successfully tying a retaining knot, difficulty may be experienced during efforts to untie the knot for temporary or permanent release of objects, such as wires or cables.

Other means have been developed for securing and bundling objects representative types of which include elongate metal and wooden rods and flexible elongate objects, such as hoses, wires and cables. Commonly used articles for attaching objects to structures or organizing them into groups include rubber bands, cable or wire ties, adhesive tapes and mechanical fastening devices. Mechanical fasteners are available in a variety of types, of which hook and loop fasteners are readily identified.

The use of hook and loop fasteners in a broad range of applications amply demonstrates their versatility. Even within a single area of application, such as securing objects or organizing them into compact bundles, there are many types of securing and wrapping devices involving hook and loop interlocking fastening elements. U.S. Pat. No. 5,142,743, for example, describes a self-attaching, self-adjusting, and reusable bundling device for wrapping and securing bundles of cable, rope, hose, electrical supply cords and other objects. The bundling device includes a two-sided, three-section strap using glued, stitched, sonic welded or otherwise attached hook and loop elements. One use of the device provides bundling of electrical cords attached to power tools and allows the user to hold the bundled cord with one hand while applying a tight wrap of the hook and loop bundling device with the other hand. Another device for a similar purpose is described in U.S. Pat. No. 5,802,676. In this case a strap for securing a bundled power cord has hook and loop elements on opposing extended surfaces and a pair of slots to receive the power cord for sliding attachment of the strap to the power cord. The attached strap, after wrapping around the bundled power cord, may be held in wrapped condition by interlock of hook elements on one side of the strap with loop elements on the other. U.S. Pat. No. 5,168,603 describes a bundling tie used to bundle a plurality of elongated members, such as wires and cables. The bundling tie comprises a flexible strap secured to an anchor member by inserting one end of the strap through a slit formed in the strap itself. An anchor member is typically a single strand of wire at the center of a wire bundle. From this position, the strap may be wrapped around the other members of the wire bundle to form an organized group of wires held together by interlock of hook and loop elements when the free end of the strap overlaps a portion of the wrapped strap.

Mechanical fastening straps, having hook and loop elements, may be used with auxiliary components such as clasps, hoops, rings and the like to facilitate increased binding tension on a group of objects. Increased binding tension occurs via the process of cinching a fastening strap against the auxiliary components. U.S. Pat. No. 4,149,540 provides a loop-forming device for attachment under tension to limbs and other objects that need to be held securely. The fastening device has a first flexible strap with hook elements on one surface and loop elements on the opposite surface. The strap includes a retaining ring that receives a free end of the strap during formation of a loop around a member. Cinching forces acting against the retaining ring may be used to increase gripping force on a member. Interlocking attachment of the free end to an outer portion of the loop substantially maintains the applied gripping force. U.S. Pat. No. 5,548,871 provides another example in which a rectangular ring facilitates loop formation using a strap having loop elements engagable with hook elements disposed on opposing sides of separate connecting tabs.

Regardless of their utility for holding and gripping single objects or groups of objects, the fastening elements of hook and loop fasteners consist of filamentary, easily deflected structures. Objects held inside a wrap of a mechanical fastener become susceptible to transverse movement. This means, for example, that a bundle of wires will slide relative to a binding formed by a hook and loop fastener so that the bundle could be displaced sideways during application of a pulling force to the wire bundle. Potential problems with such displacement indicate the need for a mechanical fastener that limits any sort of movement of objects held in a wrapped mechanical fastener.

SUMMARY OF THE INVENTION

The present invention provides an interlocking fastener, particularly of the hook and loop type, having the benefit of restricting movement of objects that have been grouped within at least a single wrap of an interlocking fastener strip. Fasteners according to the present invention comprise a planar sheet of material, preferably in elongate strip form, used as a backing material. One surface of the backing material is populated with a plurality of interlocking elements in the form of hook elements. The opposing surface of the planar sheet may also be populated with hook elements, but preferably has a plurality of loop elements that interlock with the hook elements during formation of a wrapped fastening strip. A wrapped fastening strip retains its structure by releasable engagement of overlapped opposing end portions of the interlocking fastener strip. As described above, the preferred embodiment of an interlocking fastener includes hook and loop structures as interlocking elements. The use of alternative forms of interlocking elements is within the scope of interlocking fasteners according to the present invention.

A further benefit, and distinguishing feature, of the present invention, is the placement of a deposit of pliable, conformable material over a portion of one or both surfaces of an interlocking fastener. The conformable material comprises an organic polymer, preferably an elastomeric organic polymer and most preferably an adhesive polymer. A basis for selection of pliable, conformable materials resides in their ability to exert frictional contact against one or more objects held inside a wrapped fastening strip to reduce to a minimum the freedom of movement of the confined objects. The most effective way to reduce movement of objects is to use frictional contact, against wrapped objects, combined with adhesive bond formation with portions of the objects.

Manufacture of interlocking fasteners according to the present invention requires a means-of coating to deposit a pliable, conformable material at a plurality of boundaries between areas of connecting elements on at least one side of a mechanical fastener structure. The conformable material makes at least frictional contact with one or more objects to substantially prevent them from moving after they have been confined inside a wrapped fastening strip formed by overlapping end portions of an interlocking fastener strip. Conformable materials, including mastic or adhesive products, may be applied in a variety of patterns including line patterns, rectangular or circular grid patterns and symmetrical or unsymmetrical patterns of dots of deposited material. Other patterns fall within the scope of the present invention.

More particularly the present invention provides an interlocking fastener, preferably in the form of an elongate strip, for holding at least one object in a substantially immobile condition. The interlocking fastener comprises a backing sheet having a first side opposite a second side and a first end opposite a second end. A plurality of first connecting elements, attached to the first side of the backing sheet, releasably engage a plurality of second connecting elements attached to the second side of the backing sheet during formation of a wrapped fastening strip. The interlocking fastener has a deposit of a pliable material at a plurality of boundaries between areas of the connecting elements on at least the first side of the backing sheet to provide at least frictional contact with the at least one object to substantially prevent it from moving following formation of the wrapped fastening strip by overlap of the first end and the second end. The plurality of first connecting elements may be a plurality of hook elements and the plurality of second connecting elements may be a plurality of loop elements. Pliable material may be deposited in a variety of patterns including, straight line patterns, rectangular patterns, circular or arcuate patterns and dot patterns. The patterns may be formed by any of a number of coating methods including slot coating, pattern coating, and rotogravure coating and the like, using materials including elastomers, mastics and adhesives.

Definitions

The following definitions clarify the meanings of terms used herein.

Terms such as "fastening strip," or "strip fastener" or the like include a backing sheet having opposing sides. At least one of the sides has interlocking connecting elements on its surface, while the other side may be covered with interlocking connecting elements or a deposit of a pliable material, or a combination of interlocking connecting elements and pliable material.

The terms "connecting elements," and "interlocking" or "interconnecting" elements or the like may be used interchangeably to describe structures such as hooks, and loops, and other geometric structures known for use in mechanical fasteners.

BRIEF DESCRIPTION OF THE DRAWINGS

The invention will now be described in greater detail in the following way of example only and with reference to the attached drawings in which.

DETAILED DESCRIPTION OF THE PREFERRED EMBODIMENT

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Specific structural and functional details disclosed herein are not to be interpreted as limiting, but merely as a basis for the claims and as a representative basis for teaching one skilled in the art to variously employ the present invention.

The present invention provides an interlocking fastener, particularly of the hook and loop type, having the benefit of restricting movement of objects that have been grouped within at least a single wrap of an interlocking fastener strip. Improvements according to the present invention may be applied to commonly known types of mechanical fasteners that include hooks, loops, and other shaped elements capable of interlocking engagement to provide releasable fastener structures.

A distinguishing feature of the present invention is the placement of a deposit of pliable, conformable material over a portion of one or both surfaces of an interlocking fastener. The conformable material comprises an organic polymer, preferably an elastomeric organic polymer and most preferably an adhesive polymer. A basis for selection of pliable, conformable materials resides in their ability to exert frictional contact against one or more objects held inside a wrapped fastening strip to reduce to a minimum the freedom of movement of the confined objects.

The preferred way to reduce movement of objects is to use frictional contact, against wrapped objects, combined with adhesive bond formation with portions of the objects. For example, a coating thickness between about 5.0 $\mu$m (0.2 mil) to about 1.25 mm (50 mil) of a tackified rubber material or pressure sensitive adhesive provides improved binding of grouped objects held together using a mechanical fastener. Suitable polymeric materials, such as elastomers, mastics, and adhesives and the like provide increased holding power when applied to interlocking elements on either side of mechanical fastener strips.

Figure 1:
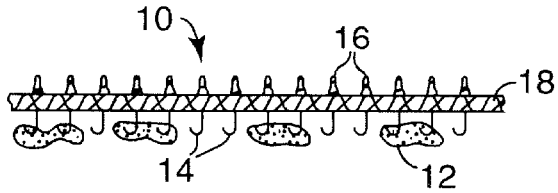
FIG. 1 is a cross sectional view of an interlocking fastener according to the present invention showing interlocking elements on a first side of a backing sheet having interconnecting elements and a deposit of pliable material on an opposing second side.
Figure 2:
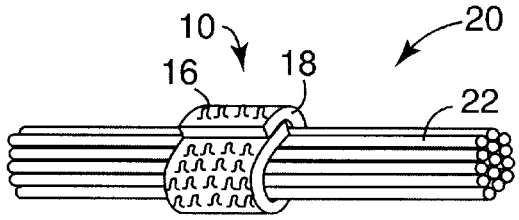
FIG. 2 is a perspective view showing a bundle of objects held in an organized arrangement using an interlocking fastener according to the present invention.
Figure 3:
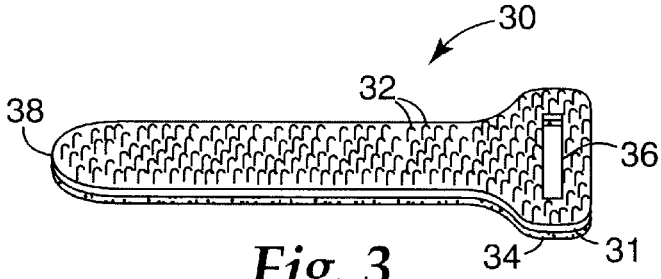
FIG. 3 is a perspective view of an alternate embodiment of an interlocking fastener according to the present invention.
Figure 4:
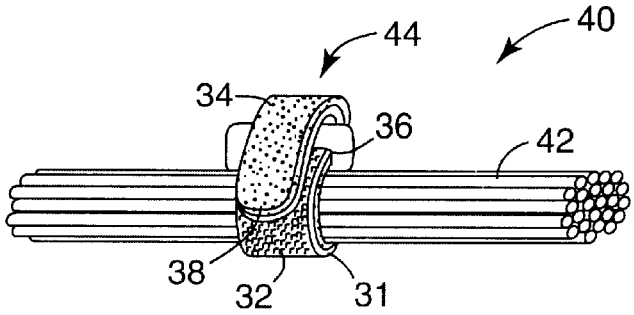
FIG. 4 is a perspective view showing a bundle of objects held in an organized arrangement using the alternate interlocking fastener illustrated in FIG. 3.
Figure 5:
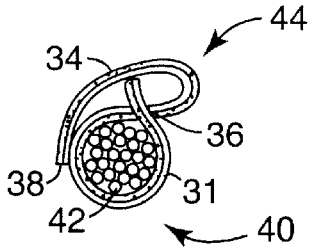
FIG. 5 is a cross sectional view showing a bundle of objects held in an organized arrangement using the alternate interlocking fastener shown in FIG. 3.
Figure 6:
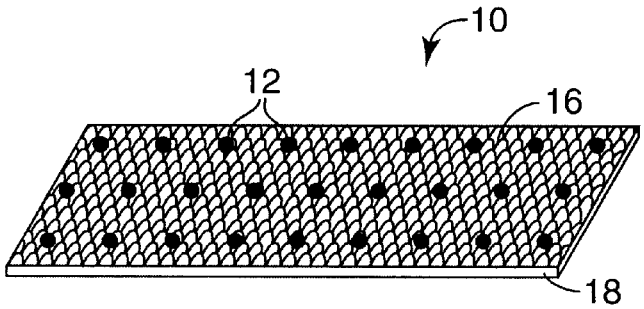
FIG. 6 is a schematic representation of a backing sheet according to the present invention, in which the backing sheet has a surface covered with a plurality of interconnecting elements in the form of loops having portions covered by areas of a pliable material.
Figure 7:
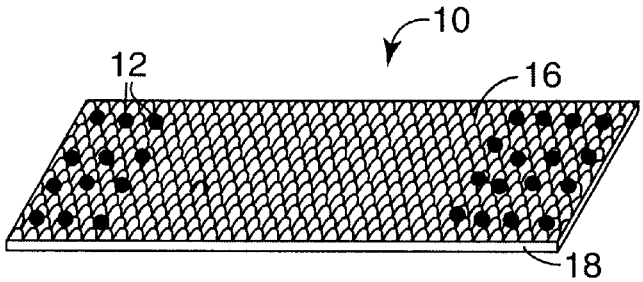
FIG. 7 is a schematic representation similar to that shown in FIG. 6 except for a difference in the distribution of pliable material on portions of the loop-covered surface of the backing sheet.
Figure 8:
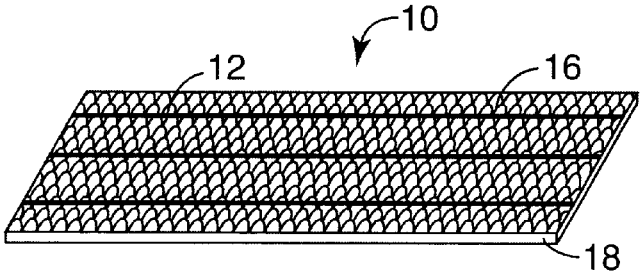
FIG. 8 is a schematic representation of a backing sheet according to the present invention, in which the backing sheet has a surface covered by narrow strips of pliable material applied to portions of interconnecting loop elements parallel to the longitudinal axis of the backing sheet.
Figure 9:
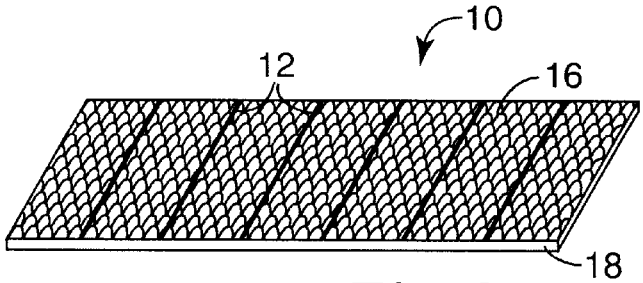
FIG. 9 is a schematic representation of a backing sheet according to the present invention, in which the backing sheet has a surface covered by narrow strips of pliable material applied to portions of interconnecting loop elements perpendicular to the longitudinal axis of the backing sheet.
Figure 10:
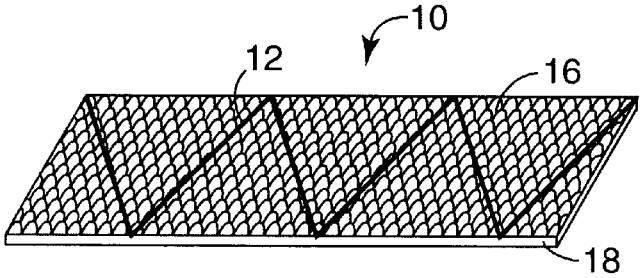
FIG. 10 is a schematic representation of a backing sheet according to the present invention, in which the backing sheet has a surface covered by narrow "zigzag" strips of pliable material applied over portions of interconnecting loop elements.
Figure 11:
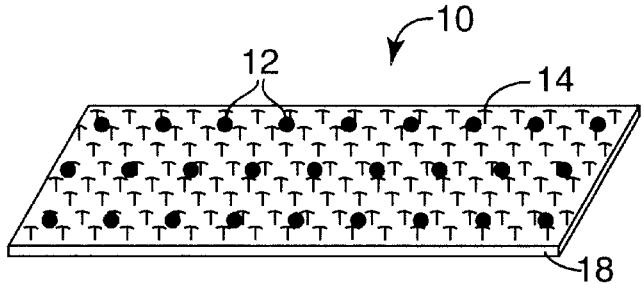
FIG. 11 is a schematic representation of a backing sheet according to the present invention, in which the backing sheet has a surface covered with a plurality of interconnecting elements in the form of hooks having portions covered by areas of a pliable material.
Figure 12:
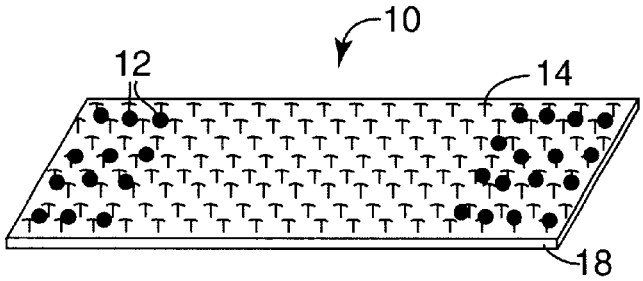
FIG. 12 is a schematic representation similar to that shown in FIG. 11 except for a difference in the distribution of pliable material on portions of the hook-covered surface of the backing sheet.
Figure 13:
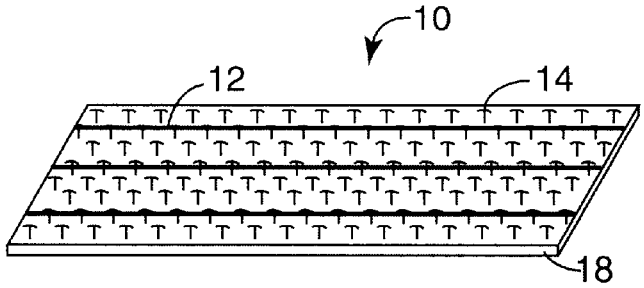
FIG. 13 is a schematic representation of a backing sheet according to the present invention, in which the backing sheet has a surface covered by narrow strips of pliable material, applied to portions of interconnecting hook elements, parallel to the longitudinal axis of the backing sheet.
Figure 14:
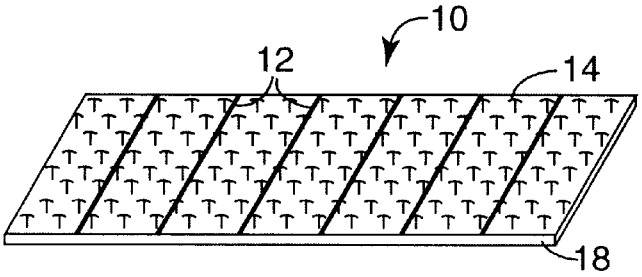
FIG. 14 is a schematic representation of a backing sheet according to the present invention, in which the backing sheet has a surface covered by narrow strips of pliable material, applied to portions of interconnecting hook elements, perpendicular to the longitudinal axis of the backing sheet.
Figure 15:
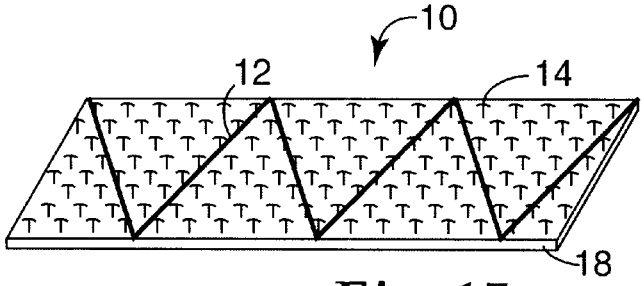
FIG. 15 is a schematic representation of a backing sheet according to the present invention, in which the backing sheet has a surface covered by narrow "zigzag" strips of pliable material applied over portions of interconnecting hook elements.

Referring now to the figures wherein like numbers refer to like parts throughout the several views, FIG. 1 is a cross sectional view of one embodiment of a fastening strip (10) according to the present invention having a deposit of a pliable material (12), applied as discrete islands of adhesive to hook elements (14) attached to the backing sheet (18) of a fastener (10) to provide improvement in the holding power of a wrapped binding (20 FIG. 2) of the fastener (10) around a group of objects (22). The use of discrete islands or sections of pliable material (12) such as adhesive leaves uncoated hook elements (14) available for interlocking engagement with loop elements (16) used for the formation of wrapped binding strips (20). Application of an excessive amount of adhesive interferes with interlock of hook (14) and loop (16) elements reducing their effectiveness for mechanical fastening. FIG. 3 provides an alternative embodiment of the present invention having interlocking elements (32) on one side of a backing sheet (31) of a fastening strip (30) and a pattern or full coating of adhesive (34) on the other. The fastening strip (30) preferably includes an opening (36) at one end sized to receive the opposite end (38) of the fastening strip (30) to form a loop, as shown in FIG. 4 and FIG. 5, that becomes a wrapped binding (40) by drawing the strip (30) through the opening (36) into a gripping relationship with a group of objects (42), such as a wire bundle. When the adhesive side (34) of the fastening strip (30) is in contact with the objects (42), the threaded end (38) of the strip (30) may be folded upon itself, for connection of the interlocking elements (32), thereby forming a folded closure (44) of interconnected connecting or interlocking elements. The folded closure (44) holds the binding (40) in place. A fastening strip (30) of this type uses adhesive (34) on its inner surface to restrict movement of objects (42), and the fastening capability of interlocking elements (32) to form a wrapped binding (40).

Manufacture of conventional mechanical fasteners uses extended substrate materials having interlocking elements of varying types covering one or both sides. Commercial mechanical fasteners for bundling applications, such as hook and loop fasteners available from Velcro Inc., Applix Inc., or 3M Company, do not provide tight bundling and such fasteners tend to slip around the cable or wire bundles. Fasteners of this type often require application of additional tension by cinching. The process of cinching is inconvenient and time consuming.

FIGS. 6–15 illustrate how further processing of conventional mechanical fastener webs, according to the present invention, provides fasteners (10) having improved binding capacity and slip resistance using a variety of coating methods, preferably pattern coating methods, to apply polymeric conformable materials (12) to interlocking elements (14, 16) on either side of the web. Lengths of hook and loop fastener materials may be coated using tackified mastic products, transfer adhesives, hot-melt adhesives and pressure sensitive adhesives applied to hook elements (14), loop elements (16) or both. Preferred embodiments of the present invention limit application of these coating materials (12) to portions of fasteners between areas of uncoated interlocking fastener elements (14, 16). Results show that full coverage of interlocking elements, by mastic or adhesive coatings, adversely affects interlocking contact between hooks and loop elements. Mastic or adhesive coverage in excess of 40% significantly reduces the effectiveness of hook and loop products for fastening applications.

Any one of a number of known coating methods may be used to apply coating materials to lengths of hook and loop fastener materials. Preferably the coating method provides a pattern coating on at least one surface of a hook and loop substrate. FIGS. 6–10 depict fastener strips (10) having pliable material (12) applied in a variety of patterns to interconnecting loop elements (16). Similarly FIGS. 11–15 depict fastener strips (10) according to the present invention having interconnecting hook elements (14) coated with varying patterns of pliable material (12). Suitable patterns include parallel longitudinal lines, parallel transverse lines, rectangular or circular grids and symmetrical or unsymmetrical patterns of dots of deposited material including mastic or adhesive products. Other patterns fall within the scope of the present invention.

Suitable coating methods for applying selected patterns include slot coating, transfer coating, and rotogravure coating of suitable web material. A preferred embodiment of an interlocking fastener according to the present invention uses a process of lamination to apply either a hot-melt or solvent-based adhesive to the surface of a hook and loop fastener. Regardless of the coating method used, the properties of the coating material allow pattern-coated webs to be converted into roll-form and thereafter unwound without transfer of coating between layers. While description has been provided in terms of hook and loop type mechanical fasteners the use of alternative forms of interlocking elements is within the scope of coated fasteners according to the present invention.

Adhesive coated mechanical fasteners according to the present invention may be converted into rolls differing in length and width depending on the requirements of a given application. Sample materials described herein typically have roll widths between one half inch and one inch. Lengths of material cut from these rolls provide bundling strips from about three inches to six inches in length depending on the dimensions of the group of objects, such as a wire bundle, to be wrapped together.

Bundling strips, used for holding wire bundles, effectively contained groups of three to four wires per bundle. A range of wires between about 16 AWG and about 20 AWG produced wire bundles having diameters from about 4.4 mm (0.175 inch) to about 7.6 mm (0.30 inch). The wires were sheathed in an insulating coating of either crosslinked polyethylene or ethylene propylene diene monomer rubber. Bundles of wires were held together using bundling strips wrapped around the wires so that there was contact between adhesive coated hooks and the surface of the insulating sheaths around the wires. The combined effect of binding, using mechanical fastener strips, and frictional contact or bonding with adhesive coated hook portions provides an effective means for binding groups of wires together. The formation of small wire bundles held together by conventional, adhesive-free, mechanical fasteners usually presents difficulties when natural recovery forces in the fastener substrate act to uncouple engaged interlocking elements. It appears that application of even discontinuous coatings of polymer and adhesive materials according to the present invention provides a solution to this problem since all the wrapped and bundled groups of wires remained in a bundled condition, showing resistance to application of lateral forces that were applied to pull the wire bundle sideways from the wrapped binder of the mechanical fastener. This performance contrasts that of similar bundles of wire held together by interlocking fastener strips from which polymer or adhesive coating was omitted. Fastener strips of the latter type could not be wrapped under the same amount of tension. Also, the application of lateral force caused wire bundles to slide easily form inside the wrapped binder.

Suitable mechanical fastener materials are commercially available, for example, from Velcro USA Inc. Manchester, N.H.- as Velcro brand hook and loop (H/L) fasteners (Get-A-Grip—Registered TM) and from 3M Company of St. Paul, Minn. Products from 3M Company include SCOTCH #100 HOOK & LOOP FASTENER, having polypropylene hooks and nylon loops, and LAMINATED SCOTCH 200 fasteners having polypropylene hooks on opposing sides of the fastener substrate.

Suitable polymer and adhesive coating materials are available from 3M Company, St. Paul, Minn. including 3M #2229 EPDM tackified mastic, and acrylate adhesives designated by product numbers including #9457, #9755, #9703, #9451, and #467MP transfer adhesives having thickness variation from 5.0 $\mu$m (0.2 mil) or less to 125.0 $\mu$m (5 mil). These materials may be applied, for example, to the nylon loop side of SCOTCH #100 HOOK & LOOP FASTENER at thickness varying from 12.5 $\mu$m (0.5 mil) to 1.25 mm (50 mil). Acrylate pressure sensitive adhesives were also derived from standard TDX acrylate pressure sensitive adhesive comprising 94% 2-ethylhexyl acrylate and 6% acrylic acid, diluted with methyl ethyl ketone, ethyl acetate and acetone and applied to the loop side in any of the different patterns identified previously.

Materials Tested

Mechanical Fasteners

Mastic and adhesive materials were coated on interlocking elements of the following hook and loop (H/L) fasteners:

a) Product SCOTCH #100 H/L fastener available from 3M Company of St. Paul, Minn. The fastener has polypropylene hooks on one of its sides and nylon loops on the other.

b) LAMINATED SCOTCH 200 FASTENER available from 3M Company, St Paul, Minn. Interlocking elements for this fastener consist of polypropylene hooks distributed on both sides of the backing material.

c) Velcro brand H/L fasteners, available from Velcro USA Inc, Manchester, N.H.

Coating Materials i) Scotch #2229—EPDM tackified mastic available from 3M Company, St. Paul, Minn.

ii) Scotch #9457, #9755 and #9703 #9451, and 467MP—Acrylate adhesives available from 3M Company, St. Paul, Minn.

iii) Solvent based acrylate pressure sensitive adhesives, available from 3M Company, St. Paul, Minn., having alphanumeric identification beginning with the prefix TDX. Adhesives of this type were diluted before coating with solvents including methyl ethyl ketone, ethyl acetate and acetone.

iv) Scotch #23 rubber adhesive splicing tape, available from 3M Company, St. Paul, Minn. as a material that is non-tacky at room temp.

Sample Preparation

Lengths of hook and loop fastener materials may be coated using tackified mastic products, transfer adhesives, hot-melt adhesives and pressure sensitive adhesives applied to hook elements, loop elements or both. Preferred embodiments of the present invention limit application of these coating materials to portions of fasteners between areas of uncoated interlocking fastener elements. Results show that full coverage of interlocking elements, by mastic or adhesive coatings, adversely affects interlocking contact between hooks and loop elements. Mastic or adhesive coverage in excess of 40% significantly reduces the effectiveness of a hook and loop product for fastening applications.

Any one of a number of known coating methods may be used to apply coating materials to lengths of hook and loop fastener materials. Preferably the coating method provides a pattern coating on at least one surface of a hook and loop substrate. Suitable patterns include parallel longitudinal lines, parallel transverse lines, rectangular or circular grids and symmetrical or unsymmetrical patterns of dots of deposited mastic or adhesive. Other patterns fall within the scope of the present invention. Patterns of this type may be applied using known coating methods including slot coating, transfer coating, and rotogravure coating of suitable web material. A preferred embodiment of an interlocking fastener according to the present invention uses a process of lamination to apply either a hot-melt or solvent-based adhesive to the surface of a hook and loop fastener.

Test Methods

Bundle Strength Test

Bundle strength was tested according to a modified version of standard test method UL 1565 developed for testing cable ties. The test procedure used fasteners, having a width of one half inch, wrapped one and one half times around a one inch diameter wire bundle consisting of 14 AWG crosslinked polyethylene wires. One single wire from each of opposing sides of the wire bundle was bent for gripping in the jaws of the tensile tester. The bent portion of each wire was substantially parallel to the axis of the fastener and perpendicular to the axis of the wire bundle. Using a jaw separation speed of one inch per minute, the bent wires were pulled against the wrapped fastenter until it failed by separation. The load at failure was recorded.

Shear Strength Test

Shear strength was tested according to a modified version of standard test method ASTM D-5169. Hook and loop fasteners, having a width of one half inch were used in this test. Samples were cut to a size of four inches by one half inch. A first strip was placed with the loop side in contact with a rigid surface. Careful alignment was made between a two inches end portion of the hook side of the first strip and the loop side of an overlapping two inches end portion of a second strip. This produced a length of hook and loop material joined together in the middle. Initial engagement of interlocking elements in the two-inch overlapping section required application of light finger pressure. Uniform interlocking engagement of hook and loop elements was then achieved using five passes of a 2.0 Kg (4.5 lbs) steel roller over the overlapped area. Opposing ends of the overlapped strip were inserted for retention in the jaws of a tensile tester. Using a jaw separation speed of 2.54 cm (one inch) per minute, a pulling force was applied to the sample until the central overlapped portion failed by separation. The load at failure Peel Strength Test Peel strength was tested according to a-modified version of standard test method ASTM D-5170. Samples preparation involved the use of strips of material, 2.54 cm (one inch) wide and 20.3 cm (eight inches) long, having hooks on one side and loops on the other. One of the 20.3 cm (eight inches) long strips was laid with the hook covered side in contact with a rigid surface. A second 20.3 cm (eight inches) long strip was aligned to fully cover the first strip with engagement of hooks of the second strip with loops of the first strip. Uniform interlocking engagement of hook and loop elements was then achieved using five passes of a 2.0 Kg (4.5 lbs) steel roller over the overlapped area. At one end of the overlapped strip the interlocking hook and loop elements were separated to provide two tabs each approximately 3.8 cm (1.5 inches) long. These two tabs were placed in opposite jaws of a tensile tester. Using a jaw separation speed of 30.5 cm (twelve inches) per minute, a pulling force was applied to the sample until there was separation of the first strip from the second strip. Test results were recorded in terms of average seperation force per unit width of interlocked fastener.

Slide Force Test

Measurement of sliding force relative to a wrapped mechanical fastener requires a test fixture having a circular hole sized to the diameter of a wire bundle before wrapping with a mechanical fastener.

Wire bundle samples were made using 12 AWG, crosslinked polyethylene wires. A bundled sample of wires was inserted into the hole in the test fixture. A mechanical fastener, one inch (2.54 cm) wide, was wrapped twice around the wire bundle, underneath the hole of the test fixture.

During measurement of sliding force, the fixture was attached to the lower jaw of a tensile tester and the wire bundle above the test fixture was gripped in the upper jaw of the tensile tester. Separation of the upper jaw from the lower jaw of the tensile tester at a rate of 2.54 cm (one inch) per minute applied pressure from the fixture to the band of hook and loop fastener wrapped around the wire bundle. Application of force causes the fastener band either to slide down the wire bundle or roll upon itself. Test results were obtained as the peak force associated with displacement of the fastener band by the lower surface of the test fixture.

EXAMPLE 1

The hook covered side of a length of SCOTCH #100 H/L fastener, one inch wide, was coated with strips of hot melt adhesive or SCOTCH #23 splicing tape approximately 1.5 mm wide. The strips formed an array of spaced apart lines parallel to the longitudinal axis of the fastener. Bands of uncoated hook fastening elements approximately 4.5 mm (0.2 inch) wide separated the strips of adhesive from each other. The strip-coated material was placed in an oven at a temperature of 130° C. for sufficient time, usually about two to three minutes, to melt and bond the adhesive to the tips of the hook elements. After processing, approximately 25% of the hook elements were covered with a coating of adhesive.

EXAMPLES C1, 2, and 3

Table 1 provides properties for strip coated mechanical fasteners similar to those of Example 1. Property measurement included bundle strength, shear strength and peel force. During measurement of bundle strength there is contact between the coated side of the fastener and surfaces of wires in the wire bundle. This test was performed using strips of SCOTCH #100 H/L fastener 2.54 cm (one inch) wide, wrapped two full wraps around a wire bundle of 1.27 cm (one half inch) diameter. The shear strength and peel strength tests require attachment of the coated hook side of fasteners with the uncoated loop side of a second strip.

Test samples included comparative Example C1, which used uncoated strips of SCOTCH #100 H/L fastener Example 2 was a partially coated sample of SCOTCH #100 H/L fastener having 40% of the hook elements coated with adhesive. Example 3 was fully coated to place adhesive on the surface of 100% of the hook elements.

TABLE 1

Properties of Mechanical Fasteners

| | Bundle Strength | | Shear strength | | Peel Force | |
|---|---|---|---|---|---|---|
| | Load at Failure (Kg) | % Decrease | Kg [[m]]/ $m^2$ | % Decrease | gm [[s]]/ cm | % Decrease |
| Example C1 | 37.4 | 0 | 15,817 | 0 | 80.4 | 0 |
| Example 2 | 33.4 | 10.4 | 10,404 | 34.2 | 53.6 | 33.3 |
| Example 3 | 6.9 | 81.4 | 4,077 | 74.2 | 5.6 | 93.1 |

The results in Table 1 show that even partial coating of interlocking elements of a mechanical fastener reduces the strength of interference bonding of interlocking elements.

Table 2 provides comparisons of the force required to cause a wire bundle to move laterally through wrapped bindings of a different types of fastener that may be used for wire bundling. Except for Velcro Brand H/L fasteners, all fastener products are available from 3M Company, St. Paul, Minn.

Test results show that without a frictional polymer or adhesive coating cable ties have the greatest resistance to lateral movement after secure wrapping around a wire bundle approximately one half inch in diameter. Uncoated hook and loop fasteners show least resistance to lateral movement. Slide force testing of coated hook and loop fasteners shows improvement in resistance to sliding depending upon the amount and possibly type of coating applied. This conclusion is based upon the better performance of fasteners having 20% of the hooks coated with SCOTCH 467MP adhesive, compared to the use of 25% coverage using strips of SCOTCH #23 splicing tape. The increased amount of the latter material significantly reduces the effective resistance to sliding. However, 25% coverage of interlocking hook elements using SCOTCH #23 splicing tape provides a four-fold improvement over uncoated SCOTCH #100 H/L FASTENER.

TABLE 2

Slide Test Results for Selected Fasteners

| Product Identification | Sliding Load at Failure (Kg[[ms]]) |
|---|---|
| SCOTCH SUPER 20 Tape | 1.6 |
| SCOTCH FILAMENT TAPE | 1.7 |
| Black Nylon Cable Tie [50 lbs (23 Kgms) rating] | 6.7 |
| White Nylon Cable Tie [120 lbs (55 Kgms) rating] | 5.7 |
| SCOTCH #100 hook and loop fastener | 1.1 |
| Velcro Brand hook and loop fastener | 1.2 |
| SCOTCH #100 H/L fastener with adhesive at 20% coverage using 467 MP crosslinked acrylic adhesive | 24.3 |
| SCOTCH #100 H/L fastener with adhesive at 25% coverage using strips of SCOTCH #23 splicing tape | 4.3 |

These data show that 3M SCOTCH #100 H/L fastener coated with adhesive offers better performance and up to four to five times the binding capacity of other available products. Improved performance involves binding of objects basted upon the properties of the mechanical fastener and immobilization of bundles of objects by frictional contact and, in some cases, bonding with adhesive coated portions of mechanical fasteners according to the present invention. An adhesive coated binding of this type is expected to offer significant resistance to vibration that could cause a binding to unwrap.

Mechanical fasteners having portions coated with polymeric materials have been described herein with particular reference to prevention of movement of objects held in a wrapped binding of a mechanical fastener. Other variations in processes and materials, which will be appreciated by those skilled in the art, are within the intended scope of this invention as claimed below.

What is claimed is:

1. A fastening strip for holding a group of objects in an organized arrangement, said fastening strip comprising:

a backing sheet having a first side opposite a second side and a first end opposite a second end;

a plurality of first connecting elements attached to said first side of said backing sheet;

a plurality of second connecting elements attached to said second side of said backing sheet to interlock with said plurality of first interconnecting elements during formation of a wrapped fastening strip; and a patterned deposit of a pliable material at a plurality of boundaries between areas of said connecting elements on at least said first side of said backing sheet, said pliable material having at least frictional contact with the group of objects to substantially prevent movement thereof from the organized arrangement following formation of said wrapped fastening strip by overlap of said first end and said second end.

2. The fastening strip of claim 1, wherein said plurality of first connecting elements is a plurality of hook elements.

3. The fastening strip of claim 1, wherein said plurality of second connecting elements is a plurality of loop elements.

4. The fastening strip of claim 1, wherein said pattern is selected from the group consisting of straight line patterns, rectangular patterns, arcuate patterns, and dot patterns.

5. The fastening strip of claim 1, wherein said pliable material is selected from the group consisting of elastomer materials, adhesives and mastics.

6. The fastening strip of claim 5, wherein said adhesives are selected from the group consisting of rubber adhesives and acrylate adhesives.

7. A fastening strip for holding a group of objects in an organized arrangement, said fastening strip comprising:

a backing sheet having a first side opposite a second side and a first end opposite a second end having an opening formed therein;

a plurality of connecting elements attached to said first side of said backing sheet;

a deposit of a pliable material on said second side of said backing sheet, said pliable material having at least frictional contact with the group of objects to substantially prevent movement thereof when the organized arrangement is surrounded by a wrapped fastening strip; and a folded closure formed by drawing said first end through said opening in said second end to form said wrapped fastening strip and thereafter folding said strip for overlapping interconnection of a portion of said plurality of connecting elements.

8. The fastening strip of claim 7, wherein said deposit is a pattern of said pliable material.

9. The fastening strip of claim 8, wherein said pattern is selected from the group consisting of straight line patterns, rectangular patterns, arcuate patterns, and dot patterns.

10. The fastening strip of claim 7, wherein said deposit is a continuous layer of said pliable material.

11. The fastening strip of claim 7, wherein said pliable material is selected from the group consisting of elastomer materials, adhesives and mastics.

12. The fastening strip of claim 11, wherein said adhesives are selected from the group consisting of rubber adhesives and acrylate adhesives.

* * * * *

UNITED STATES PATENT AND TRADEMARK OFFICE

CERTIFICATE OF CORRECTION

PATENT NO. : 6,701,580 B1
DATED : March 9, 2004
INVENTOR(S) : Bandyopadhay, Pradip K.

It is certified that error appears in the above-identified patent and that said Letters Patent is hereby corrected as shown below:

Column 3,
Line 14, “means-of” should read -- means of --.
Line 67, after “fasteners” please insert the following paragraph:

-- Terms such as “wrapped binding” or “wrapped fastening strip” or the like refer to a looped holding structure that may be secured by overlap of opposite ends of a fastening strip or by formation of a folded closure that uses overlap and interlock of connecting elements of a fastening strip that has been folded back upon itself. --

Column 9,
Line 38, after “failure”, insert -- was recorded. --.
Line 40, “a-modified” should read -- a modified --.
Line 59, “separation” should read -- separation --.

Column 10,
Line 57, Table 1, column “Shear strength”, below “Kg”, delete “[[m]]”
Line 57, Table 1, column “Peel Force, below “gm”, delete “[[s]”

Column 11,
Line 28, Table 2, second column below “Sliding”, delete “[[ms]”
Line 46, “basted” should read -- based --.

Signed and Sealed this

Eighth Day of June, 2004

JON W. DUDAS
*Acting Director of the United States Patent and Trademark Office*